US009127685B2

(12) United States Patent
Schofield et al.

(10) Patent No.: US 9,127,685 B2
(45) Date of Patent: Sep. 8, 2015

(54) REGENERATIVE VACUUM PUMP WITH AXIAL THRUST BALANCING MEANS

(75) Inventors: Nigel Paul Schofield, Horsham (GB); Michael Chung Kau Liu, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 323 days.

(21) Appl. No.: 13/318,977

(22) PCT Filed: May 18, 2010

(86) PCT No.: PCT/GB2010/050803

§ 371 (c)(1),
(2), (4) Date: Nov. 4, 2011

(87) PCT Pub. No.: WO2010/133868

PCT Pub. Date: Nov. 25, 2010

(65) Prior Publication Data

US 2012/0051893 A1 Mar. 1, 2012

(30) Foreign Application Priority Data

May 20, 2009 (GB) ..... 0908664.6
May 20, 2009 (GB) ..... 0908665.3

(51) Int. Cl.
*F04D 5/00* (2006.01)
*F04D 29/051* (2006.01)
(Continued)

(52) U.S. Cl.
CPC ..... *F04D 29/051* (2013.01); *F04D 5/005* (2013.01); *F04D 5/006* (2013.01); *F04D 5/008* (2013.01); *F04D 17/168* (2013.01); *F04D 23/008* (2013.01); *F04D 29/0513* (2013.01)

(58) Field of Classification Search
CPC ..... F04D 5/002; F04D 5/003; F04D 5/005; F04D 5/006; F04D 5/008; F04D 17/168; F04D 19/04; F04D 19/042; F04D 19/046; F04D 23/008; F04D 29/0513; F04D 29/051; F04D 29/041; F04D 29/0413
USPC ..... 415/55.1–55.7, 90, 143, 144, 104, 106; 417/423.4
See application file for complete search history.

(56) References Cited

U.S. PATENT DOCUMENTS 3,135,215 A 6/1964 Smith
3,518,021 A 6/1970 Lake et al.
(Continued)

FOREIGN PATENT DOCUMENTS

CN 1038859 A 1/1990
CN 1039088 A 1/1990
(Continued)

OTHER PUBLICATIONS

U.K. Search Report dated Sep. 1, 2009 for corresponding Application No. GB0908664.6.
(Continued)

*Primary Examiner* — Christopher Verdier
(74) *Attorney, Agent, or Firm* — Westman, Champlin & Koehler, P.A.

(57) ABSTRACT

A vacuum pump rotor suitable for use in a vacuum pump is described for a vacuum pump that comprises a regenerative pumping mechanism. The rotor has a generally disc-shaped configuration and is mounted on an axial shaft for rotation relative to a stator of a vacuum pump. The rotor has a first and second opposing surface on which a rotor formations are disposed, each rotor formation defining a portion of a pump stage formed between the pump rotor and a stator for pumping gas from an inlet to an outlet in the same radial direction along the first and second opposing surface. A conduit is provided to interconnect the portions of the pump stage and assist with pressure imbalance that might occur on opposing sides of the rotor.

13 Claims, 7 Drawing Sheets

(51) Int. Cl.
*F04D 17/16* (2006.01)
*F04D 23/00* (2006.01)

(56) References Cited

U.S. PATENT DOCUMENTS

| | | | | |
|---|---|---|---|---|
| 3,560,104 | A | 2/1971 | Neale | |
| 3,951,567 | A | 4/1976 | Rohs | |
| 4,445,820 | A | 5/1984 | Hayashi et al. | |
| 4,556,363 | A * | 12/1985 | Watanabe et al. | 415/55.6 |
| 4,723,888 | A | 2/1988 | Watanabe et al. | |
| 4,854,830 | A | 8/1989 | Kozawa et al. | |
| 5,009,575 | A | 4/1991 | Hanai et al. | |
| 5,137,418 | A | 8/1992 | Sieghartner | |
| 5,354,172 | A | 10/1994 | Schofield | |
| 5,358,373 | A * | 10/1994 | Hablanian | 415/90 |
| 5,498,124 | A | 3/1996 | Ito et al. | |
| 5,904,469 | A | 5/1999 | Cerruti | |
| 6,709,243 | B1 | 3/2004 | Tan et al. | |
| 2002/0021975 | A1 | 2/2002 | Marx et al. | |
| 2003/0026686 | A1 | 2/2003 | Kusagaya et al. | |
| 2003/0039539 | A1 | 2/2003 | Harris et al. | |
| 2003/0175110 | A1 | 9/2003 | Schmidt et al. | |
| 2003/0175111 | A1 * | 9/2003 | Miura et al. | 415/55.1 |
| 2004/0013529 | A1 | 1/2004 | Englander et al. | |
| 2004/0022652 | A1 * | 2/2004 | Miura et al. | 417/423.1 |
| 2004/0028521 | A1 * | 2/2004 | Penzar et al. | 415/55.1 |
| 2004/0170493 | A1 * | 9/2004 | Jager et al. | 415/55.1 |
| 2004/0191054 | A1 * | 9/2004 | Honda et al. | 415/55.1 |
| 2006/0269394 | A1 * | 11/2006 | Ishikawa et al. | 415/55.1 |
| 2007/0264117 | A1 * | 11/2007 | Yoshida et al. | 415/55.1 |
| 2008/0080964 | A1 * | 4/2008 | Geissel | 415/55.1 |
| 2010/0021282 | A1 | 1/2010 | Geissel | |

FOREIGN PATENT DOCUMENTS

| | | | |
|---|---|---|---|
| CN | 101392758 | A | 3/2009 |
| DE | 733758 | | 4/1943 |
| DE | 2112762 | A1 | 3/1971 |
| DE | 4244458 | A1 | 7/1993 |
| DE | 102006053933 | A1 | 5/2008 |
| EP | 0568069 | A2 | 11/1993 |
| EP | 0608444 | A1 | 8/1994 |
| EP | 0735271 | A2 | 10/1996 |
| EP | 0770781 | A1 | 5/1997 |
| EP | 1046786 | A3 | 1/2002 |
| EP | 1170508 | A1 | 1/2002 |
| EP | 1191227 | A2 | 3/2002 |
| GB | 1402713 | | 8/1975 |
| GB | 2036870 | A | 7/1980 |
| GB | 2073819 | A | 10/1981 |
| JP | S50133510 | | 10/1975 |
| JP | H03182697 | A | 8/1991 |
| JP | H06179880 | A | 6/1994 |
| JP | 2004116509 | A | 4/2004 |
| JP | 2005320913 | A | 11/2005 |
| JP | 2008069681 | A | 3/2008 |
| JP | 2008223553 | A | 9/2008 |
| JP | 2009220771 | A | 10/2009 |
| WO | 9111619 | A2 | 8/1991 |
| WO | 9907990 | A1 | 2/1999 |
| WO | 2010133866 | A1 | 11/2010 |
| WO | 2010133867 | A1 | 11/2010 |

OTHER PUBLICATIONS

U.K. Search Report dated Sep. 1, 2009 for corresponding Application No. GB0908665.3.

PCT International Search Report dated Aug. 30, 2010 for corresponding PCT Application No. PCT/GB2010/050801.

PCT Written Opinion dated Aug. 30, 2010 for corresponding PCT Application No. PCT/GB2010/050801.

PCT International Search Report dated Aug. 27, 2010 for corresponding PCT Application No. PCT/GB2010/050802.

PCT Written Opinion dated Aug. 27, 2010 for corresponding PCT Application No. PCT/GB2010/050802.

PCT International Search Report dated Aug. 27, 2010 for corresponding PCT Application No. PCT/GB2010/050803.

PCT Written Opinion dated Aug. 27, 2010 for corresponding PCT Application No. PCT/GB2010/050803.

First Office Action dated Sep. 10, 2013 and Chinese Search Report dated Aug. 30, 2013 for corresponding Chinese Application No. 201080021887.2.

Response dated Jul. 9, 2012 for corresponding European Application No. 10720669.0-1267.

First Office Action dated Sep. 29, 2013 and Chinese Search Report dated Sep. 13, 2013 for corresponding Chinese Application No. 201080021884.9.

First Office Action dated Sep. 18, 2013 and Chinese Search Report dated Aug. 28, 2013 for corresponding Chinese Application No. 201080021898.0.

Prosecution history from corresponding U.S. Appl. No. 13/318,974 including: Office Action dated Feb. 12, 2014 and Amendment dated May 8, 2014.

Prosecution history from corresponding U.S. Appl. No. 13/318,966 including: Office Action dated Feb. 10, 2014 and Amendment dated May 8, 2014.

Notification of Reason for Rejection dated Feb. 17, 2014 for corresponding Japanese Application No. JP 2012-511347.

Notification of Reason for Rejection dated Mar. 3, 2014 for corresponding Japanese Application No. JP 2012-511348.

Notification of Reason for Rejection dated Mar. 3, 2014 for corresponding Japanese Application No. JP 2012-511349.

Prosecution history of U.S. Appl. No. 13/318,966 including: Final Office Action dated Aug. 5, 2014, Response dated Oct. 3, 2014 and Advisory Action dated Oct. 14, 2014.

Prosecution history of U.S. Appl. No. 13/318,974 including: Final Office Action dated Jul. 29, 2014, Response dated Sep. 29, 2014 and Advisory Action dated Oct. 3, 2014.

Office Action dated Jul. 8, 2014 for Chinese Application No. 201080021898.0.

Office Action dated Jul. 8, 2014 for Chinese Application No. 201080021884.9.

Office Action dated Jul. 15, 2014 for Chinese Application No. 201080021887.2.

Notice of Allowance dated Jun. 4, 2015 for corresponding U.S. Appl. No. 13/318,966.

Amendment dated Feb. 25, 2015 and Office Action dated Nov. 25, 2014 for corresponding U.S. Appl. No. 13/318,966.

Amendment dated Mar. 4, 2015 and Office Action dated Dec. 17, 2014 for corresponding U.S. Appl. No. 13/318,974.

Office Action dated Feb. 9, 2015 from corresponding Chinese Application No. 201080021884.9.

Office Action dated Mar. 2, 2015 from corresponding Japanese Application No. 2012-511347.

Third Office Action dated Mar. 31, 2015 for corresponding Chinese Application No. 201080021898.0.

Third Office Action dated Mar. 31, 2015 for corresponding Chinese Application No. 201080021887.2.

Office Action dated Jun. 19, 2015 for corresponding U.S. Appl. No. 13/318,974.

Communication dated Jun. 24, 2015 for corresponding European Application No. 10720668.2-1607.

Communication dated Jun. 24, 2015 for corresponding European Application No. 10720669.0-1607.

* cited by examiner

REGENERATIVE VACUUM PUMP WITH AXIAL THRUST BALANCING MEANS

CROSS-REFERENCE TO RELATED APPLICATION

This Application is a Section 371 National Stage Application of International Application No. PCT/GB2010/050803, filed May 18, 2010, which is incorporated by reference in its entirety and published as WO 2010/133868 A1 on Nov. 25, 2010 and which claims priority of British Application No. 0908644.6, filed May 20, 2009 and British Application No. 0908665.3, filed May 20, 2009.

BACKGROUND

The present invention relates to a pump for pumping fluid media (gases or liquids). In particular, but not exclusively, the present invention relates to a vacuum pump configured as regenerative vacuum pump.

The present invention is described below with reference to vacuum pumps, although it is understood that the invention is not limited in any way to vacuum pumps and can equally apply to other types of pump, such as liquid pumps, gas compressors, or the like.

Vacuum pumps which comprise a regenerative pumping mechanism are known hereto. Known regenerative pumping mechanisms comprise a plurality of annular arrays of rotor blades which are mounted on a rotor and extend axially from the rotor into respective annular channels formed in a stator. Rotation of the rotor causes the blades to travel along the channels forming a gas vortex which flows along a flow path between an inlet and an outlet of the pumping mechanism.

Examples of this type of vacuum pump are known in the art and specific variations of the pump are described in EP0568069 and EP1170508. Regenerative pumping mechanisms described in these documents can comprise a rotor which is formed in a disc-like configuration with pump elements on either side of the rotor. The pumped gas follows a flow path arranged such that the gas flows along one side of the rotor from an inlet and is then transferred in a serial fashion to the other side of the rotor and thence onwards to an outlet.

SUMMARY

The present invention provides an improved pump over conventional pumps.

Accordingly, there is provided a vacuum pump rotor which is suitable for use in a vacuum pump, said pump comprising a regenerative pumping mechanism, said rotor having a generally flat disc configuration and being mountable on an axial shaft for rotation relative to a stator of a vacuum pump, wherein the rotor has a first surface and second surface opposite the first surface, and a rotor formation is disposed in the first and second surface, each rotor formation defining a portion of a pump stage formed between the pump rotor and a stator so that gas can be pumped from an inlet to an outlet and in the same radial direction along the first and second opposing surface, and wherein a conduit is provided to interconnect the portions of the pump stage. As a result, the conduit provides a means by which pressure imbalance across the rotor can be compensated for.

It can be arranged for the conduit to pass through the rotor or for the conduit to be disposed in a stator. Furthermore, the rotor can comprise at least two pump stages arranged to compress pumped gas passing from the inlet to the outlet such that a first pump stage disposed close to the inlet is operable at a lower pressure than a second pump stage nearer to the outlet, and the conduit is disposed at the second pump stage. Also, the conduit can comprise a plurality of discrete gas passages arranged to interconnect the portions of the pump stage.

In addition, the present invention provides vacuum pump comprising a rotor as described above, said pump further comprising a stator having a first and second surface, each stator surface being arranged to face one of the first or second rotor surfaces, wherein each stator surface comprises a concentric channel arranged to cooperate with one of the rotor formations to form a gas flow path on the pump stage.

Additionally, the first and second surfaces of the stator and rotor can be arranged to be flat, the stator channels can be arranged to extend below the stator surface, and the rotor formations can be arranged to extend below the rotor surface.

Additionally, a gas seal can be formed between the rotor and stator to reduce leakage of gas from the pump stage, said gas seal comprising flat portions of the stator and rotor surfaces that face one another. Thus, the flat surfaces of the respective rotor and stator facing each other cooperate to form a gas seal device: to achieve this the first and second surfaces of stator can be arranged to be planar and parallel to one another.

The present invention provides a pump comprising a regenerative pumping mechanism having a generally disc-shaped pump rotor mounted on an axial driveshaft for rotation relative to a stator, the pump rotor having rotor formations disposed in a surface and defining at least a portion of a flow path for pumping gas from an inlet to an outlet and being formed between the pump rotor and the stator of the pumping mechanism, the pump rotor and the stator comprising an axial gas bearing arranged to control axial clearance between the rotor and the stator during pump operation. Thus, this configuration of pump provides a gas bearing disposed on the rotor which enables an improved control of axial clearance between the pump's rotor and stator components.

Alternatively, or in addition, the present invention provides a pump comprising a regenerative pumping mechanism which comprises a generally disc-shaped pump rotor mounted on an axial shaft for rotation relative to a stator, the pump rotor having first and second surfaces each having a series of shaped recesses formed in concentric circles thereon, and a stator channel formed in a surface of the stator which faces one of the pump rotor's first or second surfaces, wherein each of the concentric circles is aligned with a portion of a stator channel so as to form a section of a gas flow path extending between an inlet and an outlet of the pump, and the pump rotor divides the section of flow path into sub-sections such that gas can flow towards the outlet simultaneously along any sub-section. As a result, the gas being pumped flows in a parallel fashion along both surfaces of the rotor. Thus, this configuration can provide a pumping mechanism where gas pressures on either side of the rotor can be substantially equal or balanced.

Alternatively, or in addition, the present invention provides a regenerative pump rotor comprising a generally disc-shaped pump rotor mountable onto an axial shaft for rotation relative to a pump stator, the pump rotor having first and second surfaces each having a series of shaped recesses formed in concentric circles thereon and being configured to face a stator channel formed in a surface of a stator, wherein, during use each of the concentric circles is aligned with a portion of a stator channel so as to form a section of a gas flow path extending between an inlet and an outlet of a vacuum pump and the gas flow path is divided by the rotor such that gas can flow towards the outlet simultaneously along the first and second surfaces. Thus, this configuration can provide a pumping rotor mechanism where gas pressures on either side of the rotor can be substantially equal or balanced.

The axial gas bearing can comprise a rotor part on the pump rotor and a stator part on the stator. This configuration allows relatively easy manufacture of multiple pump parts on relatively few components.

The stator can comprise two stator portions located adjacent respective axial sides of the pump rotor, the rotor formations are disposed on each of the axial sides of the pump rotor, and the flow path is divided by the pump rotor into sub-flow paths so that gas can flow simultaneously along each axial side of the pump rotor to the outlet. In addition, the sub-flow paths can be arranged to be symmetrical about a radial centre line of the pump rotor. Additionally, first and second flow path sub-sections can be defined by first and second surfaces disposed on both sides of the pump rotor and first and second stator channels facing the respective one of pump rotor's first and second surfaces, respectively. Furthermore, a first flow path sub-section defined by the first stator channel and a second flow path sub-section defined by the second stator channel can be arranged to pump an equal volume of gas. Yet further, the first and second flow path sub-sections can be arranged to direct gas in the same radial direction, for example to direct gas from an inner radial position of the pump rotor to an outer radial position. This configuration provides a balanced pumping arrangement whereby pressure exerted by the pumped gases on either side of the rotor is substantially equal to one another. As a result, the axial clearance between the rotor and stator pump components can be maintained at a relatively small distance thereby reducing gas leakage between the rotor and stator, which in turn can improve pumping efficiency.

An axial gas bearing rotor component can be arranged to cooperate with a gas bearing stator component for controlling the axial running clearance between the rotor and a pump's stator during a pump's operation. Furthermore, a portion of the axial gas bearing component is in the same plane as the first surface. The axial gas bearing can comprise rotor parts on each axial side of the pump rotor and which are co-operable with stator parts on respective stator portions so that gas that has been pumped along the flow paths can pass between the two parts on each axial side of the rotor. In other words, the exhaust gas can be used to supply at least a portion of the gas needed to operate the gas bearing. As a result, the pumped gases can be used to drive the axial gas bearing.

The inlet of the regenerative pumping mechanism can be located at a radially inner portion of the pump and the outlet is located at a radially outer portion of the pump. Thus, the gas flow path is arranged such that gas being pumped flows from the inner portion of the mechanism to the outer portion of the mechanism. In addition, if the air bearing is located at a radial outer portion of the pump rotor and the stator proximate the outlet then the gases at higher 'outlet pressures' can be used to drive the bearing. Furthermore, this arrangement can allow the axial running clearance between the pump rotor and stator to be in the order of either one of less than 40 μm, less than 30 μm, less than 20 μm, or less than 15 μm. Indeed, the clearance can be approximately 8 μm. Such clearances are typically much smaller than those that can be achieved on conventional regenerative pump mechanisms. As a result, pumped gas leakage between the rotor and stator can be minimised, thereby leading to a potential improvement in pump efficiency and/or throughput.

Furthermore, surfaces of the pump's mechanism can be coated with a material that is harder than the material from which the component is made. For instance, at least one of the pump rotor surface having rotor formations disposed therein; a stator surface facing the pump rotor surface; or a surface of the pump rotor or stator comprising the axial gas bearing can be coated with such material. The coating material can be any one of a nickel PTFE matrix, anodised aluminium, a carbon-based material, or a combination thereof. What is more, the carbon-based material can be any one of Diamond-like material, or synthetic diamond material deposited by a chemical vapour deposition (CVD) process. Such hard coatings can be used to help protect the pump components from wear. Also, the coating can help prevent particulates entrained in the pumped gas stream from entering the clearance space between the pump rotor and stator.

First and second surfaces of the pump rotor can be arranged parallel to one another. Also, advantageously the first and second surfaces can be arranged to have flat surfaces (that is planar surfaces) wherein the plane of the first surface is parallel to the plane of the second surface. Furthermore, a portion of the axial gas bearing component can be arranged to be in the same plane as either the first or second surface. As a result, the surfaces can be machined, lapped or polished to a relatively high degree of flatness. This can help maintaining a small axial clearance between the rotor and stator pump components.

Other preferred and/or optional aspects of the invention are described herein and defined in the accompanying claims.

BRIEF DESCRIPTION OF THE DRAWINGS

In order that the present invention may be well understood, an embodiment thereof, which is given by way of example only, will now be described with reference to the accompanying drawings, in which.

DETAILED DESCRIPTION

Figure 1:
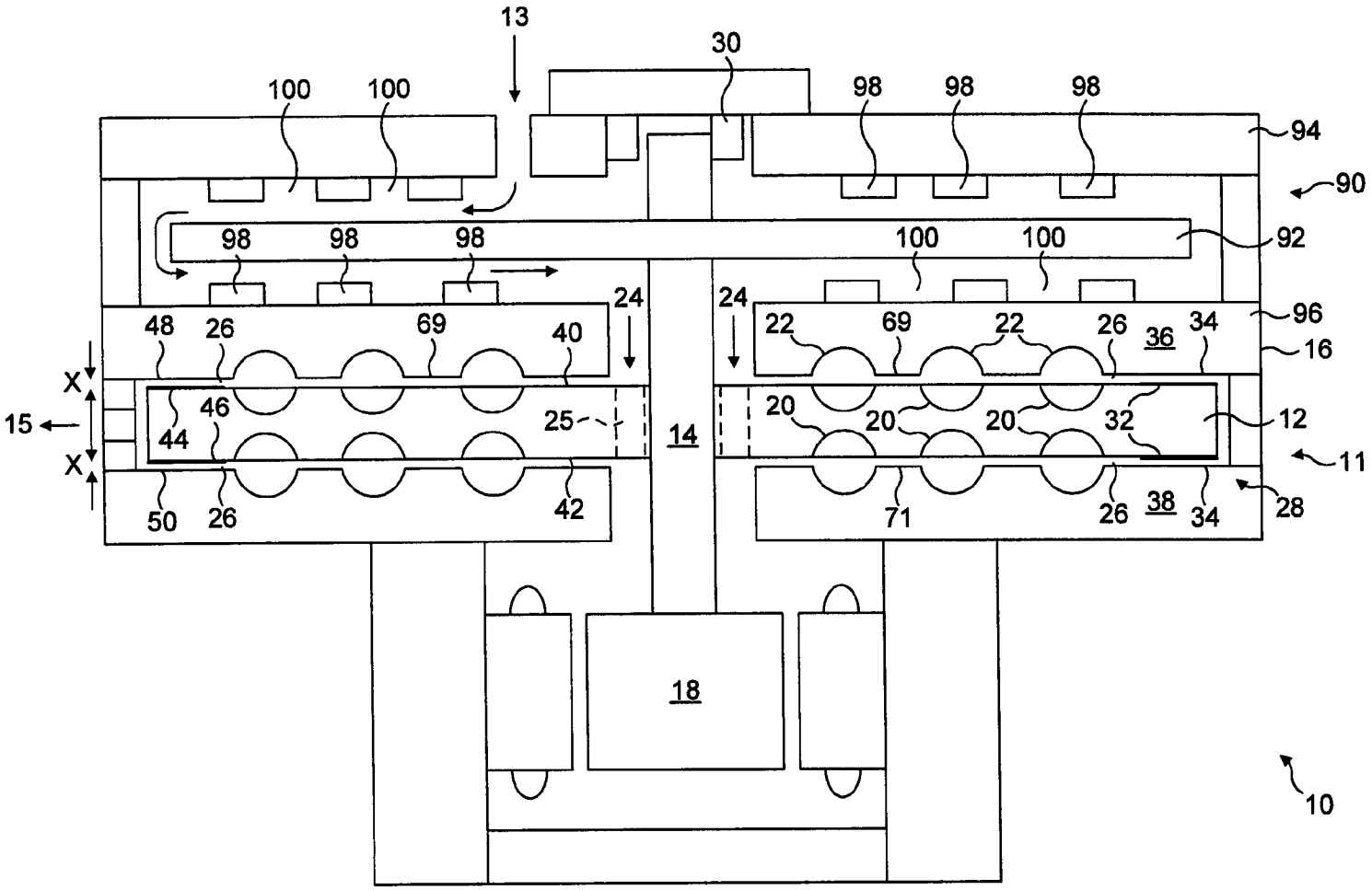
FIG. 1 shows schematically a vacuum pump.

Referring to FIG. 1, a vacuum pump 10 is shown which comprises a regenerative pumping mechanism 11. The vacuum pump has an inlet 13 for connection to an apparatus or chamber to be evacuated, and an outlet 15 which typically exhausts to atmosphere. The vacuum pump shown in FIG. 1 further comprises a molecular drag pumping mechanism 90 disposed upstream of the regenerative mechanism and which is explained in more detail below.

The regenerative pumping mechanism comprises a generally disc-shaped rotor 12 mounted on an axial shaft 14 for rotation relative to a stator 16. The shaft is driven by a motor 18 and may rotate at speeds of between 10,000 rpm and 75,000 rpm and preferably at around 40,000 rpm. The rotor 12 has a plurality of rotor formations 20 for pumping gas along channels 22 in the stator along a flow path between an inlet 24 and an outlet 26 of the pumping mechanism when the rotor is rotated. The inlet and the outlet are shown in more detail in FIG. 3. As explained in more detail below, the rotor formations are recesses formed in each of the planar axially facing surfaces of the rotor.

The rotor 12 and the stator 16 comprise an axial gas bearing 28 for controlling axial clearance X between the rotor and the stator. A passive magnetic bearing 30 controls the radial position of the rotor 12 relative to the stator 16.

The axial gas bearing 28 comprises a rotor part 32 on the pump rotor and a stator part 34 on the stator. The bearing is located at a low vacuum, or atmospheric, part of the pumping mechanism proximate the outlet 26. The gas bearing is beneficial because it allows a small axial running clearance between rotor and stator which is necessary for reducing leakage of pumped gas from the channel and producing an efficient small pump. Typical axial clearances achievable in embodiments of the invention are less than 30 μm and even in the range of 5-15 μm.

Although an air bearing is able to produce small axial running clearances, air bearings are not well suited to carrying relatively heavy loads. Accordingly, in FIG. 1, the stator 16 comprises two stator portions 36, 38 located adjacent respective axial sides 40, 42 of the rotor and the rotor comprises rotor formations 20 on each axial side thereof for pumping gas through channels 22 in respective stator portions 26, 28 along respective flow paths between inlets 24 and outlets 26. In this way, the flow path is split or divided by the rotor such that sub-flow paths are mirrored about an axial centre line of the rotor 12: the pumped gas flows in parallel (in the same radial direction) along both sides of the rotor. Forces generated during pumping are generally balanced (i.e. there is no net loading exerted by the pumped gas) to such an extent that the air bearing 28 is able to resist the applied loading. In other words, the gas being pumped and compressed by the pumping mechanism will exert an axial load on the rotor and stator of the pumping mechanism. The arrangement described above results in a net axial load being applied to the rotor which is substantially equal to ON (zero Newtons) because the axial loads on either side of the rotor are typically equal and applied in opposite directions so as to cancel one another out.

However, to try and ensure that the rotor and stator do not clash during pump operation it might be necessary to provide an arrangement that can balance the pressure on either side of the rotor for respective pump stages. The rotor shown in FIGS. 1 and 6 has three pump stages between the inlet 24 and outlet 15. Each stage of the pump comprises respective rotor formations 20 on opposing surfaces of the rotor. In other words, the rotor formations on one side of the rotor disc 12 form a portion of the pump stage and the rotor formations on the other, opposing side of the rotor form the other portion of the pump stage. That is, each pump stage is split into two sub-stages disposed on either side of the rotor disc.

A pressure imbalance between or across respective pump sub-stages (that is, the pressure being higher in one pump sub-stage with respect to the pressure in the respective pump sub-stage disposed on the opposite side of the rotor disc) could cause the clearance between the rotor and stator on one side of the rotor to increase with respect to the clearance on the other side of the rotor. This in itself would result in a difference of leakage rate between neighbouring pump stages depending on the side of the rotor—the leakage rate would be greater on the side where the clearance is largest. In extreme pressure imbalance cases the rotor and stator could clash causing damage to the pump mechanism.

Pressure imbalance might occur for a number of reasons, but in a pump where the clearance between the rotor and stator is relatively small (below 30 microns, for instance), or a pump having a relatively large compression ratio, we have found that it is important to balance the pressure across matched pump sub-stages by cross-connecting matching pump sub-stages on the upper and lower surfaces of the rotor or stator to help avoid the potential problems discussed above.

Figure 6:
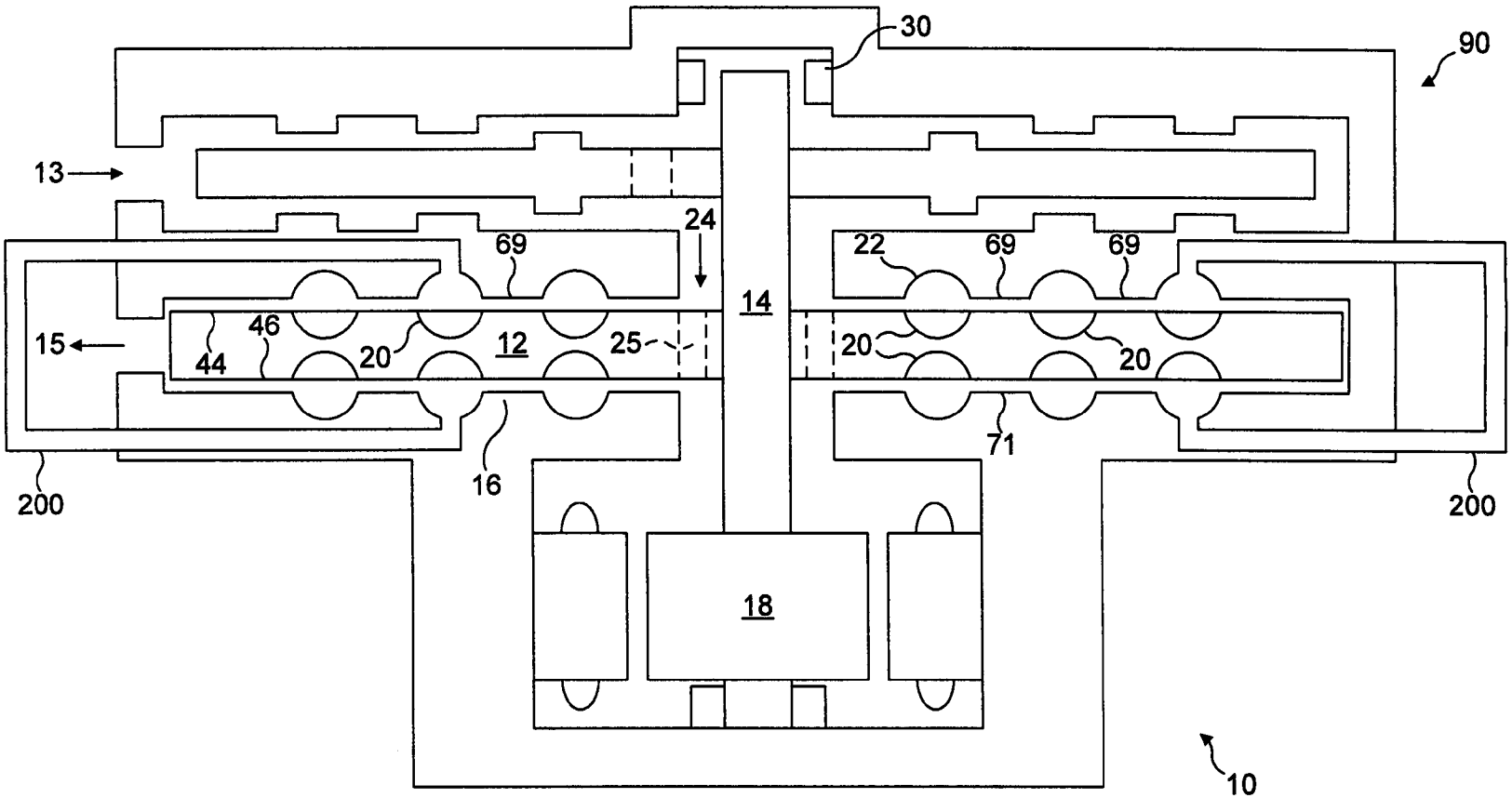
FIG. 6 shows a schematic view of a pump according to an aspect of the present invention.

A first scheme for balancing pressure can be achieved by external porting as shown in FIG. 6. Respective stator channels or conduits 22 on either side of the rotor are linked by a conduit 200 to allow gas to flow between respective stages on opposite sides of the rotor and thereby reduce or eliminate any pressure imbalance across the rotor.

Figure 7:
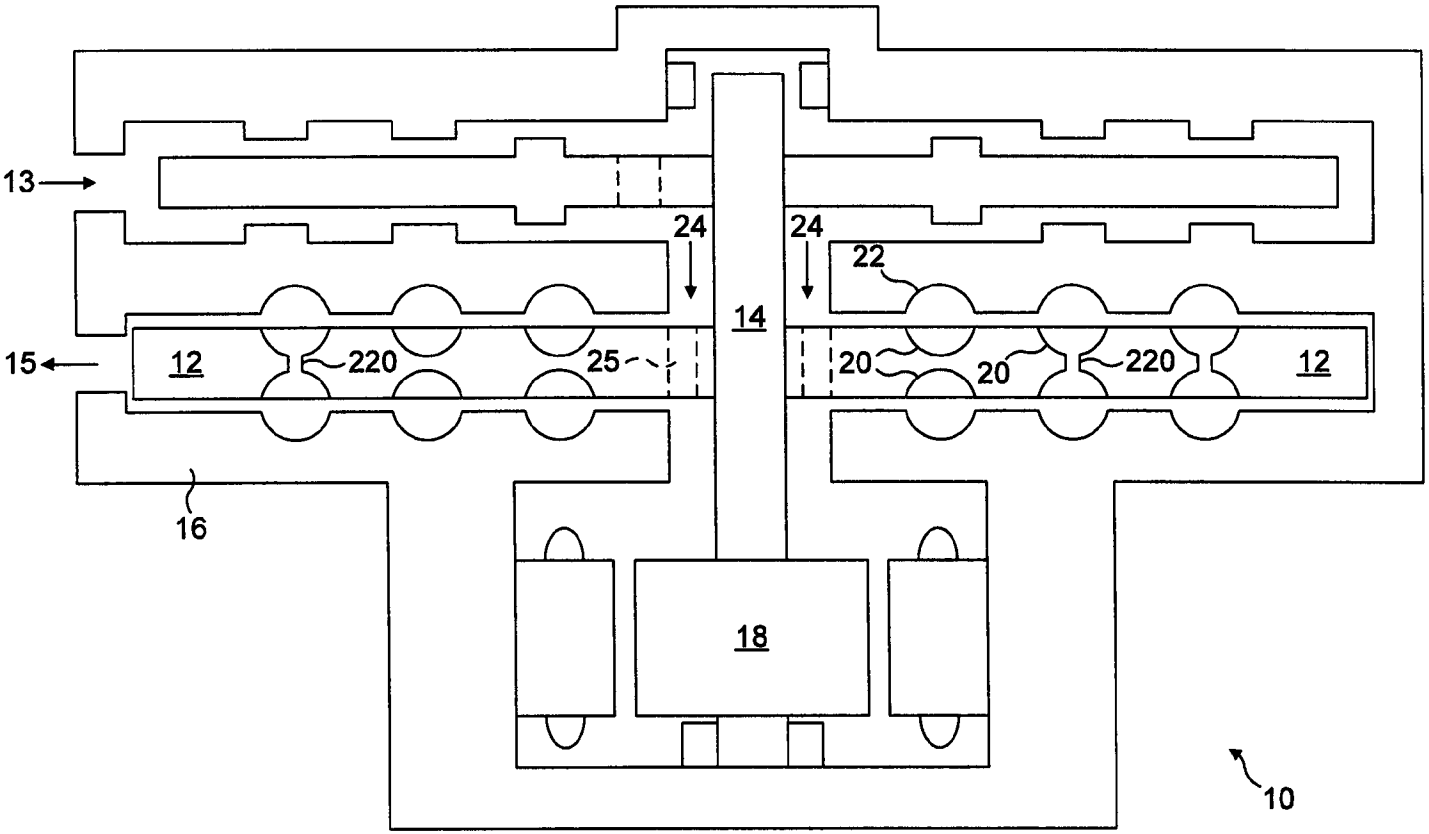
FIG. 7 shows a schematic view of an alternative pump according to an aspect of the present invention.

A second scheme as shown in FIG. 7 is provided for balancing pressure. Pressure differential across the rotor can be balanced by providing through holes or conduits 220 passing through the rotor to allow gas to pass from one side of the rotor to the other at discrete locations. A number of gas passages can be arranged at different locations around the pump stage to assist with providing an even distribution of gas within discrete pump stages should a pressure imbalance occur. For instance, four or five through holes or conduits can be provided at evenly distributed locations around one pump stage. In this arrangement, the through-holes can be arranged at the bottom of the rotor formation, or at the flat surface located between the rotor formations of a pump stage.

Pressure imbalance is likely to have the most detrimental effect in the pump stages which operate at higher pressures relative to the other pump stages. Furthermore, in the arrangement shown in FIG. 7, the so-called exhaust stages (operating at higher pressure) are disposed furthest from the rotational shaft 14 which drives the rotor 12. Thus, in this arrangement torque applied to the rotor by an imbalance of pressure in the exhaust stages can cause the rotor 12 to twist out of axial alignment with the stator 16. As a result, the stator 16 and rotor 12 can clash. The provision of pressure balancing means across at least the exhaust stages of a multi-stage pump is preferred to safeguard against the likelihood of pressure imbalance causing pump malfunctions.

Prior to the pump stages, the rotor comprises at least one through-bore 25 shown in broken lines in FIG. 1 for allowing the passage of gas therethrough from one axial side of the rotor to the other axial side of the rotor. The through-bore allows gas to be pumped along flow paths on each axial side of the rotor.

In order to control the axial clearance between the upper surface 40 of the rotor and stator portion 36 and the axial clearance between the lower surface 42 of the rotor and stator portion 38, the axial gas bearing 28 comprises rotor parts 44, 46 on each axial side of the rotor. The rotor parts 44, 46 are co-operable with stator parts 48, 50 on respective stator portions 36, 38 so that gas in the exhaust region feeds into the space between the bearing components and controls the axial clearances X between the rotor and both the stator portions. What is more, gases pumped along the flow paths can pass between the two parts 44, 48; 46, 50 on each axial side of the rotor and form at least a portion of gas utilised in the bearing.

Figure 3:
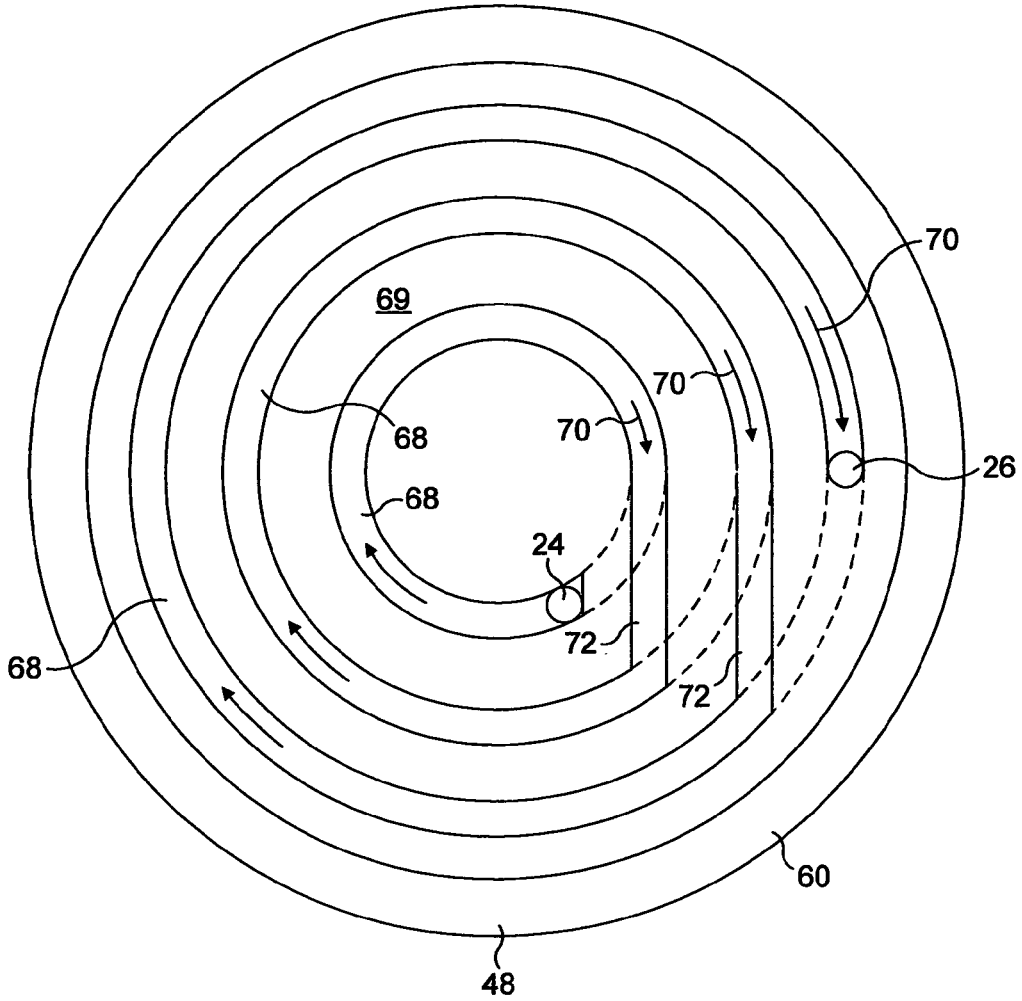
FIG. 3 is a plan view of a stator of the vacuum pump shown in FIG. 1.

As shown in more detail in FIGS. 1 and 3, the inlets 24 are located at a radially inner portion of the pumping mechanism 11 and the outlets 26 are located at a radially outer portion of the pumping mechanism. The radially outer portion of the mechanism is at relatively higher pressure than the radially inner portion. Typically, the pump exhausts to atmosphere or relatively low vacuum. The gas bearing is located at the radial outer portion of the pumping mechanism at low vacuum since the gas bearing requires a sufficient amount of gas to support the rotor relative to the stator. In prior art regenerative mechanisms, the inlet is typically located at a radial outer portion and the outlet is located at a radially inner portion. However, when using a gas bearing it is preferable to locate the bearing at an outer radial portion of the rotor and the stator because it provides greater stability and can more accurately control the axial clearance X. Therefore, in the present embodiment, the inlet and outlet locations are interchanged so that the gas bearing is at an outer radial portion proximate the relatively high pressure outlet so that not only does it receive sufficient gas for operation but also it provides greater support and stability. An additional advantage to providing the outlet of the pumping mechanism at an outer radial portion is that particulates entrained in the gas flow are generally urged by centrifugal force towards the outlet and out of the pumping mechanism.

Figure 2:
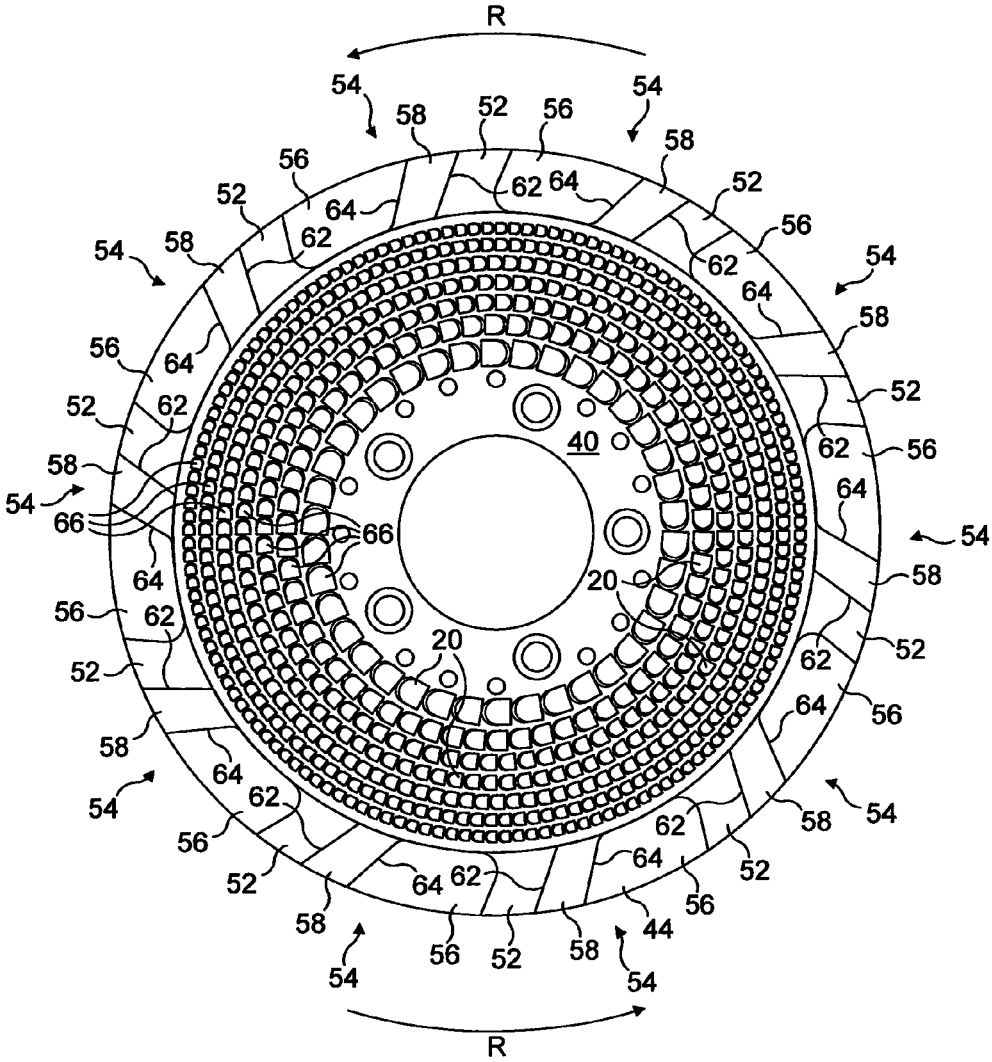
FIG. 2 is a plan view of a rotor of the vacuum pump shown in FIG. 1.

The gas bearing will now be described in more detail with reference to FIGS. 2 and 3. FIG. 2 shows a plan view of an upper axial side 40 of the rotor 12 and FIG. 3 shows a plan view of stator portion 36.

In FIG. 2, the rotor part 32 of the gas bearing is located at an outer radial portion of the rotor and comprises a plurality of bearing surfaces 52 distributed equally about the circumference of the rotor to provide a symmetrical bearing force on the rotor. The bearing surfaces are level with, or in the same plane as, the upper surface 40 of the rotor. Respective recessed portions 54 are located at the leading edges of bearing surfaces 52 with respect to a direction R of rotation (anti-clockwise in this example). In this example, the recessed portions 54 each comprise two recessed surfaces 56, 58 recessed by different depths from the bearing surface and decreasing in depth towards the bearing surface. The recessed surface 56 is relatively deep in the region of 1 mm from the upper surface 40 of the disc 12. The recessed surface 58 is relatively shallow in the region of 15 μm from the upper surface 40.

The stator part 48 shown in FIG. 3 comprises a planar circumferential bearing surface 60 which extends through a radial distance comparable to that of the rotor bearing surface 52. The bearing surface 60 is level with, or in the same plane as, the planar surface 69, 71 of the stator portions 36, 38.

It will be appreciated that in an alternative arrangement the bearing surfaces 52 may be provided on the stator and the circumferential bearing surface 60 may be provided on the rotor.

In use, the deeper recessed surfaces 56 together with bearing surface 60 of the stator trap ambient air or gas exhausted through outlet 26. Rotation of the rotor causes the trapped gas to be urged between stepped surface 58 and stator surface 60 thereby increasing in pressure as it is compressed by the shallower depth of the intermediate pocket. The step between the deeper pocket and the bearing surface allows a more gradual increase in pressure and therefore promotes the flow of gas between the bearing surface 52 and stator surface 60. Gas is subsequently urged between bearing surface 52 and stator surface 60 further increasing in pressure as the gas is compressed. The axial clearance X is controlled by the distance between bearing surface 52 and stator surface 60 where the relatively high pressure gas supports the rotor and resists axial movement relative to the stator. That is, the bearing arrangements on both axial sides of the rotor together resist movement in both axial directions. Typically, the axial clearance between bearing surface 52 and stator surface 60 is between 10 and 30 μm and preferably 15 μm.

The leading edges 62 between the bearing surface 52 and recessed portion 54 are angled with respect to a radial direction so that particulates along the flow path or paths are directed downstream towards the pump outlet 15 by the leading edges 62 during use by the action of centrifugal force. In this example, the angle is approximately 30° although other angles may be adopted as required. Similarly, the intersections 64 between the recessed surfaces 56, 58 are angled with respect to the radial direction also so that particulates along the flow paths are directed towards the outlet. The angle of the intersections 64 and the leading edges 62 are preferably the same so that gas travelling over the surface 58 or the bearing surface 52 travels approximately the same distance at an inner radial location and an outer radial location so that pressure is generally equal across the surfaces. There is a small difference between such angles as the tangential speed of the rotor is greater at an outer radial location than at an inner radial location of the surfaces.

The air bearing surfaces may be made from a ceramic or coated with a ceramic since such materials provide a relatively flat and low friction surface suitable for gas bearings. When operation of the rotor is commenced the rotor and the stator are initially in contact and rub until the speed reaches about 1000 rpm. Once the rotor builds sufficient speed the gas bearing supports the rotor away from the stator. Preferably therefore, the surfaces of the gas bearing are very smooth or self-lubricating.

The relative radial positioning of the rotor and the stator can be controlled by a passive magnetic bearing 30 shown in FIG. 1. In an alternative arrangement a ball bearing may be adopted. However, a magnetic bearing provides a dry bearing which might be preferred for certain vacuum pump applications. Further, in a small pump of this kind which is configured to be run at relatively high speeds, the combination of a gas bearing and a magnetic bearing provides a contact free bearing arrangement with relatively little resistance to rotation. Additionally, the gas bearing resists relative movement of the magnetic bearing elements in the axial direction. A back-up bearing may be provided (not shown) in case of failure of the magnetic bearing.

The regenerative pumping mechanism of the present embodiment will now be described in more detail with reference to FIGS. 2 to 5.

The planar, flat surfaces 40, 42 of the rotor are closely adjacent and parallel to the planar, flat surfaces 69, 71 of the stator portions 36, 38. The rotor formations 20 of the rotor 12 are formed by a series of shaped recesses (or buckets) arranged in concentric circles 66, or annular arrays, in the planar surfaces 40, 42 of the rotor. In the present embodiment, the formations are formed in both surfaces 40 and 42, although in other arrangements, the rotor recesses may be provided in only one axial side of the rotor. In FIG. 2, seven concentric circles of recesses 20 are shown, however, greater or fewer numbers can be provided depending on requirements. A plurality of generally circumferential channels 68 are formed in planar surface 69 of the first stator portion 36 and aligned with the concentric circles 66 formed in one face 40 of the rotor. A second plurality of generally circumferential channels 68 are formed in planar surface 71 of the second stator portion 38 and aligned with the concentric circles 66 formed in the other face 42 of the rotor. It will be noted that only three channels 68 are shown in FIG. 3 for simplicity although a stator adapted for use with the rotor shown in FIG. 2 would comprise seven channels aligned with each of the seven concentric circles 66.

The planar surfaces 40, 69 of the rotor and the stator on the one axial side and the planar surfaces 42, 71 on the other axial side are each separated by an axial running clearance X. As the running clearance is small, leakage of gas from the recesses and channels 68 is resisted so that a gas flow path 70 is formed on each side of the rotor from an inlet 24 to an outlet 26 of the pumping mechanism. Accordingly, when the rotor is rotated the shaped recesses generate a gas vortex which flows along the flow path. In other words, flat or planar portions of the stator and rotor surfaces that face one another and which are located between pump stages (or between adjacent gas flow paths) act as a seal to reduce gas leakage from the pump stage or flow path: planar portions of the respective stator and rotor surfaces cooperate to form a gas seal between adjacent pump stages.

The stator channels 68 are circumferential throughout most of their extent but comprise a generally straight section 72 for directing gas from one channel to a radially outer channel. Thus, these straight sections are analogous with the so-called "stripper" sections found on conventional regenerative pumps which also act to transfer gas from one pump channel to the next. The shaped recesses 20 pass over the planar surface 69 of the rotor as shown by the broken lines in FIG. 3.

In a known regenerative type pumping mechanism, the rotor formations are typically blades which extend out of the plane of a rotor surface and overlap with a plane of a stator surface. The blades are arranged in concentric circles which project into channels in the stator aligned with the concentric circles of the rotor. On rotation of such a prior art rotor, the blades generate a gas vortex compressing the gas along a flow path. There is a radial clearance between the blades or blade supporting member of the rotor and the channels which controls seepage of gas from the flow path. Operation of the pump causes the parts of the pump to increase in temperature however the rotor typically increases in temperature more than the temperature increase of the stator. The increase in temperature causes expansion of the rotor and the stator most significantly in the radial direction. As the rotor expands to a different extent to that of the stator, the radial clearance between the rotor blades or blade supporting member and the stator must be sufficiently large to accommodate the differential expansion rates so that the rotor blades or blade supporting members do not come into contact with the stator. Inevitably therefore, the radial clearance is relatively large and allows leakage of gas from the flow path.

In the present embodiment, the axial running clearance X between planar surfaces 40, 69 and 42, 71 of the rotor and the stator controls sealing of the flow path (i.e. between successive circles, or wraps, of the flow path). This arrangement is shown more clearly in FIG. 1 in which three wraps are shown. Leakage of gas from a high pressure channel at a radially outer portion of the mechanism to a lower pressure channel radially inward therefrom is resisted because the axial clearance is small, preferably less than 50 μm, more preferably in the range of 10 μm to 30 μm, and most preferably about 15 μm. In the present arrangement, the gas bearing is able to provide sufficiently small axial running clearance so that seepage from the flow path is acceptably small. Moreover, there is no overlap between the rotor and the stator in the axial direction. Accordingly, any differential expansion in the radial direction between the rotor and the stator can be readily accommodated without increased seepage because expansion in the radial direction does not affect the axial clearance X between the rotor and the stator. Differential radial expansion may cause a small misalignment between the channels of the stator and the concentric circles of the rotor but such a misalignment does not significantly affect pumping.

A further advantage of providing recesses in the rotor surface, rather than blades extending axially from the surface, is that recesses are more readily manufactured, for example by milling or casting. What is more, the rotor and stator surfaces can be machined, lapped or polished to a flat surface with a relatively high degree of surface flatness and to a high tolerance level. This allows the relative surfaces of the rotor and stator to pass within close distances during pump operation without clashing. As a result, the top surfaces 69, 71 of the stator are flat and planar. Likewise, the pump recesses 20 depend from the planar top surfaces 40, 42 of the rotor. Thus, the planar rotor surface and the planar stator surface act to prevent gas flow between adjacent concentric pumping arrays. In other words, the flat surfaces seal the respective pumping stage, as described above.

The recesses formed in the rotor will now be described in more detail with reference to FIGS. 4*a*, 4*b*, 5*a* and 5*b*, which show respectively a sectional view and a plan view of a first example of the recesses and a sectional view and a plan view of a second example of the recesses.

Figure 4A:
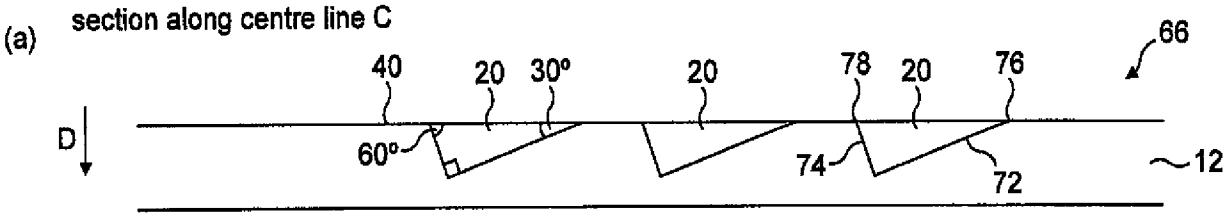
FIG. 4*a* shows a sectional view of a portion of one circle of rotor formations of the rotor shown in FIG. 2.
Figure 4B:
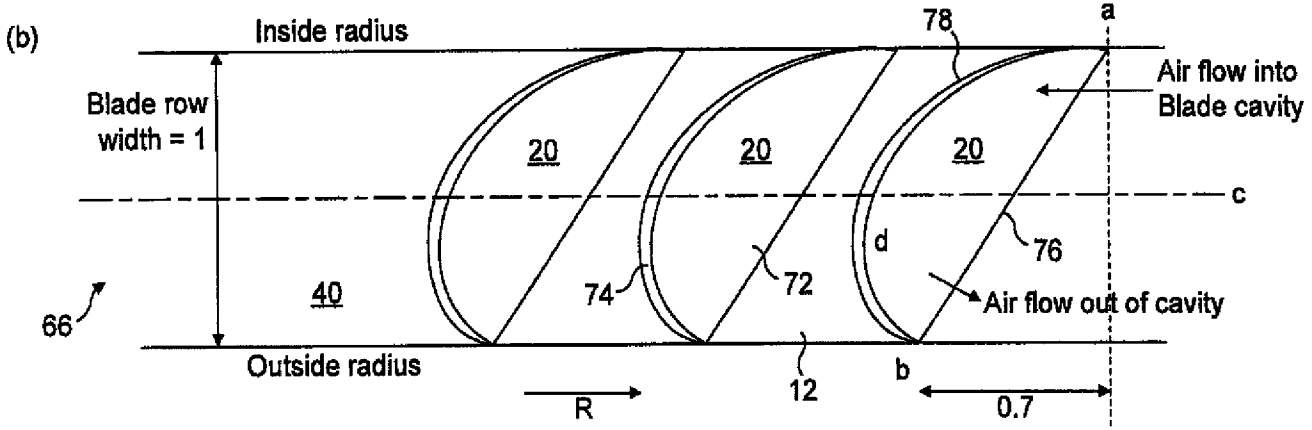
FIG. 4*b* shows a plan view of a portion of one circle of rotor formations on the rotor.

FIG. 4*a* shows a section taken through a circle 66 of rotor recesses 20 along central line C shown in FIG. 4*b*. FIG. 4*b* shows a plan view of the circle 66 of the rotor. The recesses are shaped so that in use they impart momentum to gas in a flow direction of the gas vortex along the flow path 70. That is, the recesses interact with gas along the flow path 70 to generate and maintain a gas vortex in the flow path. In addition to creating and maintaining the vortex the interaction of the recesses with the gas compresses the gas increasing vorticity or the rate at which the gas spins along the flow path.

As shown in FIGS. 4*a* and 4*b*, a recess 20 is formed generally by an asymmetric cut in one of the planar surfaces 40 of the rotor 12. The recess has a leading portion 72 and a trailing portion 74 with respect to a direction of rotation R. The leading portion is formed by gradually increasing a depth D of the recess from an angled leading edge 76. In this regard, the leading edge 76 is angled at about 30° (+/−10°) to the planar surface 40. The trailing portion is formed by a relatively steep decrease in depth D to a trailing edge 78. The trailing portion is at approximately right angles to the leading portion and at an angle of about 60° (+/−10°) with the planar surface 40. The trailing portion 74 forms a curved surface which turns through about 180° with respect to direction R and approximates generally to a changing direction of flow of gas in the vortex. The ratio of distance along central line C between point 'a' and point 'b' and the width of the recess perpendicularly to the central line 'C' is about 0.7:1.

In use, the rotor is rotated in direction 'R' and gas enters the recess at point 'a' of the leading edge 76. At point 'a' the flow direction of the vortex is generally parallel to both the curved surface 74 and the leading portion (about 30°). An arrow in FIG. 4*b* indicates the flow direction "Air flow into blade cavity". The angle of the curved trailing portion 74 and the angle of the leading portion 72 increases the amount of gas which enters the recess as it is complementary with the flow direction of gas in the vortex. Gas in the recess is directed around the curved trailing portion 74. It will be seen from the plan view in FIG. 4*b* that the gas is turned through approximately 90-180° so that when the gas flows out of the recess it is flowing in a generally right-angular or opposite direction to when it entered the recess. Moreover the gas is turned more quickly as it approaches the exit point 'b' of the trailing portion thereby imparting momentum to the gas and compressing gas along the flow path 70. The leading portion 72 gradually increases in depth as the gas flows along the trailing portion 74 until it reaches the deepest part of the recess at point 'd'.

Figure 5A:
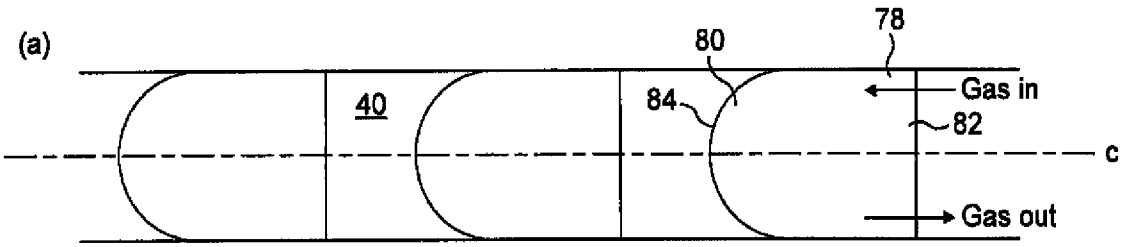
FIG. 5*a* shows in more detail an alternative rotor formation.
Figure 5B:
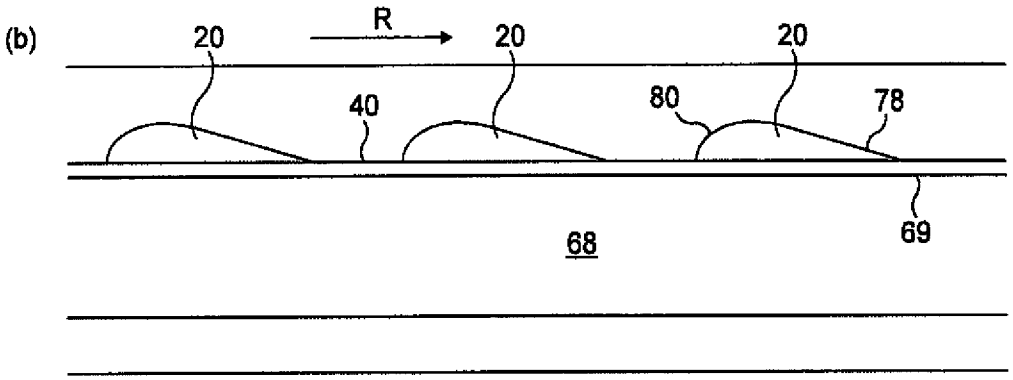
FIG. 5*b* shows a section view of the rotor and the stator taken along a central line C of FIG. 5*a*.
Figure 5C:
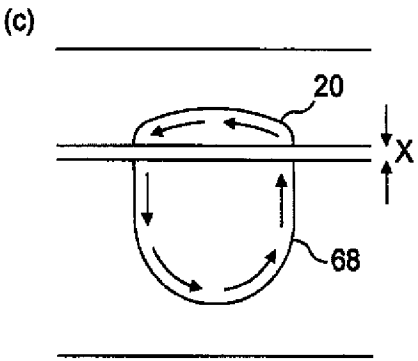
FIG. 5*c* shows a section view of the rotor and stator through a recess shown in FIG. 5*a* and a channel in the stator taken along a line perpendicular to central line C in FIG. 5*a*.

A second example of the recesses is shown in FIGS. 5*a*, 5*b* and 5*c*. FIG. 5*a* shows a plan view of the recesses. FIG. 5*b* shows a section taken along a central line C of the rotor and the stator. FIG. 5*c* shows a section through a recess and channel taken along a line perpendicular to central line C.

Unlike the recess shown in FIGS. 4*a* and 4*b*, the recess shown in FIGS. 5*a*, 5*b*, and 5*c* is symmetrical. The recess 20 is formed generally by a symmetric cut in one of the planar surfaces 40, 42 of the rotor 12. The recess has a leading portion 78 and a trailing portion 80. The leading portion is formed by gradually increasing a depth of the recess from an angled leading edge 82. In this regard, the leading portion is angled at about 30° (+/−10°) to the planar surface 40. The trailing portion 80 is formed by relatively steep decrease in depth to a trailing edge 84. The leading portion transfers smoothly by a curved surface into the trailing portion. The trailing portion 80 forms a curved surface which turns through about 180° and approximates generally to a changing direction of flow of gas in the vortex. The leading edge 82 is at right angles to the central line C.

In use, the rotor is rotated in direction 'R' and gas enters the recess at the leading edge 82. The flow direction of the vortex is into the recess at an angle which approximates to 30° and generally parallel to central line C. An arrow in FIG. 5*a* indicates the flow direction "gas in". The angle of the curved trailing portion is generally aligned with the flow direction at the inlet. Gas in the recess is directed around the curved trailing portion 80. It will be seen from the plan view in FIG. 5*a* that the gas is turned through approximately 180° so that when the gas flows out of the recess it is flowing in a generally opposite direction to when it entered the recess thereby imparting momentum to the gas and compressing gas along the flow path 70.

FIG. 5*c* shows a flow direction of the gas vortex within the conduit formed by the recesses 20 and the stator channels 68.

A coating on either the rotor and/or stator surfaces can assist with reducing wear. During the pump's start phase, as the rotor spins-up and reaches operation speed, the surfaces of the rotor and stator are likely to contact and rub against one another. This rubbing occurs whilst the rotor is rotating at a speed below a threshold level when the axial air bearing is not operating. Above this threshold, the air bearing provides sufficient "lift" to separate the rotor and stator components. By providing a hardened and/or self-lubricating coating the amount of wear can be controlled or limited. Furthermore, a coating can assist with preventing particles entrained in the pumped gas stream from entering the clearance gap between the rotor and stator. This is perceived as a particular problem due to the relatively small gap between the rotor and stator components. If dust particles, or the like, of a certain diameter or size are able to get into this gap they could act as an abrasive subjecting the pump components to excessive wear. In a worst case scenario the pump could seize.

Many suitable coatings are envisaged, but the coating material can be any one of a nickel PTFE matrix, anodised aluminium, a carbon-based material, or a combination thereof. What is more, the carbon-based material can be any one of Diamond-like material (DLM), or synthetic diamond material deposited by a chemical vapour deposition (CVD) process. It is not necessary for the coating to be of the same material on both the rotor stator—different coating can be chosen to take advantage of each coating's properties. For instance, the stator component could be coated with a self-lubricating coating, whilst the rotor is coated with diamond-like material. Other surface treatments can be used, such as plasma anodic arc surface treatment of aluminium surfaces.

In the embodiment shown in FIG. 1, the regenerative pumping mechanism 11 is in series with an up-stream molecular drag pumping mechanism 90. The molecular drag pumping mechanism 90 in this embodiment comprises a Siegbahn pumping mechanism which comprises a generally disc-shaped rotor 92 mounted on the axial shaft 14 for rotation relative to the stator. The stator is formed by stator portions 94, 96 located on each axial side of the rotor disc 92. Each stator portion comprises a plurality of walls 98 extending towards the rotor disc and defining a plurality of spiral channels 100. As the gas bearing 28 supports the rotor of the regenerative pumping mechanism and the regenerative pumping mechanism and the Siegbahn pumping mechanism are both mounted to shaft 14, the gas bearing provides axial support to the rotor of the Siegbahn mechanism. In use, a flow path through the Siegbahn mechanism is shown by arrows which passes radially outwardly over a first or upper axial side of the rotor and radially inwardly along a second or lower axial side of the rotor.

The radial location of the rotor relative to the stator is controlled by the bearing 30, which is a passive magnetic bearing. As indicated above, the bearing arrangements are both non-contact dry bearings which are particularly suitable for dry pumping environments.

The combination of the regenerative pumping mechanism 11 and the Siegbahn pumping mechanism provides a vacuum pump that is capable of pumping ten cubic meters per hour and yet is relatively smaller than existing pumps.

Alternative embodiments of the present invention will be envisaged by the skilled without departing from the scope of the claimed invention. For instance, the through-bore 25 can comprise a series of bores disposed through the rotor.

The invention claimed is:

1. A vacuum pump rotor for use in a vacuum pump comprising a regenerative pumping mechanism, said rotor having a generally disc-shaped configuration and being mountable on an axial shaft for rotation relative to a stator of the vacuum pump, wherein the rotor comprising:

first and second opposing planar surfaces;

concentric circles of shaped recesses disposed on both the first and second opposing planar surfaces;

at least one through-bore in the rotor from the first opposing surface to the second opposing surface, the at least one through-bore located radially inward from an innermost circle of shaped recesses on the first planar surface;

at least one conduit extending from a portion of the first planar surface located between two shaped recesses in a first circle of shaped recesses through the rotor to a portion of the second planar surface located between two shaped recesses in a second circle of shaped recesses wherein the first circle of shaped recesses and the second circle of shaped recesses between together form an exhaust pump stage; and a circumferential gas bearing disposed on both the first and second planar surfaces and located such that the circle of shaped recesses of the exhaust pump stage is positioned radially between the circumferential gas bearing and the other concentric circles of shaped recesses on both the first and second planar surfaces.

2. The rotor as claimed in claim 1, wherein the concentric circles of shaped recesses in the first planar surface compress pumped gas such that an inner circle of shaped recesses in the first planar surface is operable at a lower pressure than an outer circle of shaped recesses in the first planar surface and wherein the concentric circles of shaped recesses in the second planar surface compress pumped gas such that an inner circle of shaped recesses in the second planar surface is operable at a lower pressure than an outer circle of shaped recesses in the second planar surface.

3. The rotor according to claim 1, wherein the conduit comprises a plurality of discrete gas passages.

4. The rotor of claim 1 wherein the gas bearing comprises a planar region, a first recess extending from the planar region at a first recess depth and a second recess extending from the first recess at a second recess depth, wherein the second depth is greater than the first depth.

5. The vacuum pump rotor of claim 1 wherein the at least one conduit consists of five conduits evenly distributed around the exhaust pump stage.

6. The vacuum pump rotor of claim 1 wherein the at least one conduit consists of four conduits evenly distributed around the exhaust pump stage.

7. A vacuum pump comprising:

a generally disc-shaped rotor mounted to an axial shaft for rotation and having a first planar rotor surface on a first side and a second planar rotor surface on a second side, each rotor surface having concentric circles of shaped recesses;

a stator having a first stator surface and a second stator surface, each stator surface being arranged to face one of the first or second rotor surfaces, wherein each stator surface comprises concentric channels with each channel facing and aligned with one of the circles of shaped recesses to form a pump stage thereby forming a plurality of pump stages on each side of the rotor such that gas is pumped between pump stages in a same radial direction on each side of the rotor;

wherein a conduit is provided in the stator to interconnect an exhaust pump stage on the first side of the rotor to an exhaust pump stage on the second side of the rotor to allow the passage of gas for balancing the pressure in the exhaust pump stage, wherein the conduit is separated from an outlet by the exhaust pump stages.

8. The vacuum pump according to claim 7, wherein a gas seal is formed between the rotor and stator to reduce leakage of gas from each of the plurality of pump stages, said gas seal comprising flat portions of the stator and rotor surfaces that face one another.

9. The vacuum pump of claim 7 wherein gas is pumped between pump stages from an inner radius to an outer radius on each side of the rotor.

10. The vacuum pump of claim 9 wherein the rotor further comprises at least one through-bore before the pump stages such that a portion of a gas flow passes through the at least one through-bore to form a sub-flow on each side of the rotor.

11. A vacuum pump comprising:

a rotor comprising:

two parallel planar surfaces on opposite sides of the rotor, each surface having a plurality of recesses associated with a plurality of pump stages; and at least one through-bore;

a stator comprising two planar surfaces, each surface comprising a plurality of channels with each channel associated with one of the plurality of pump stages;

an inlet that directs a gas flow to the at least one through-bore such that a portion of the gas flow passes through the through-bore to produce a first sub-flow over one surface of the rotor and a second sub-flow over the other surface of the rotor; and a conduit in the stator connecting an exhaust pump stage on a first side of the rotor to an exhaust pump stage on a second side of the rotor such that the conduit is separated from an outlet of the pump by at least the exhaust pump stage on the first side of the rotor and the exhaust pump stage on the second side of the rotor.

12. The vacuum pump of claim 11 further comprising a gas bearing positioned radially outward from an exhaust pump stage on one side of the rotor and a second gas bearing positioned radially outward from an exhaust pump stage on the other side of the rotor.

13. The vacuum pump of claim 12 wherein the conduit connects an exhaust pump stage on the first side of the rotor to an exhaust pump stage on the second side of the rotor such that the pressure of the gas provided to the gas bearing by the exhaust pump stage on one side of the rotor is substantially the same as the pressure of the gas provided to the gas bearing by the exhaust pump stage on the second side of the rotor.

* * * * *

UNITED STATES PATENT AND TRADEMARK OFFICE

CERTIFICATE OF CORRECTION

PATENT NO. : 9,127,685 B2
APPLICATION NO. : 13/318977
DATED : September 8, 2015
INVENTOR(S) : Nigel Paul Schofield et al.

It is certified that error appears in the above-identified patent and that said Letters Patent is hereby corrected as shown below:

In the Claims

In column 12:

In Claim 1, line 50, delete “between”

In column 14:

In Claim 11, line 24, delete “at least”

Signed and Sealed this
Tenth Day of May, 2016

Michelle K. Lee

Michelle K. Lee
*Director of the United States Patent and Trademark Office*